US005536012A

United States Patent [19]

D'Amico

[11] Patent Number: 5,536,012

[45] Date of Patent: Jul. 16, 1996

[54] GOLF CLUB INCLUDING POSITIONING AID

[76] Inventor: John D'Amico, 53 Wittenburg Ct., Oceanport, N.J. 07757

[21] Appl. No.: 502,075

[22] Filed: Jul. 14, 1995

[51] Int. Cl.[6] ..... A63B 69/36

[52] U.S. Cl. ..... 473/238; 473/268

[58] Field of Search ..... 273/187.4, 187.6, 273/163 A, 81 D, 194 R, 186.2, 186.3, 187.5, 164.1, 162 R, 162 B, 162 F

[56] References Cited

U.S. PATENT DOCUMENTS

| | | | |
|---|---|---|---|
| 2,771,678 | 11/1956 | Hansen | 273/194 R |
| 2,919,491 | 1/1960 | Darrell et al. | 273/162 B X |
| 3,253,829 | 5/1966 | Ford | 273/194 R X |
| 3,779,398 | 12/1973 | Hunter | 273/187.4 |
| 3,953,033 | 4/1976 | Kelly et al. | 273/187.6 |
| 4,167,268 | 9/1979 | Lorang | 73/163 A |
| 5,294,126 | 3/1994 | Armstrong | 273/187.6 X |
| 5,388,834 | 2/1995 | Dawson | 273/81 D X |

OTHER PUBLICATIONS

"Getting Started in Golf" by Doug Ford, published in 1985 by Simon and Shuster, New York, pp. 41, 53, 68 and 71.

"The Golf Swing Simplified" by John Jacobs, published in 1993 by Lyons and Burford. p. 64.

*Primary Examiner*—George J. Marlo

[57] ABSTRACT

Apparatus for stance improvement includes an aperture which may have optical sight therein, located in the grip or shaft of a golf club so that the ground or light is visible to the player when the club is properly aligned, the player's feet, knees, hips, and shoulders are properly located; and the player's head is in the correct position to hit a straight golf shot with an iron or fairway wood on which the golfer's downward line of sight intersects the club grip or shaft. The aperture is positioned at the point of intersection between the club grip or shaft and the line of sight. Several such apertures may be formed in the shaft and/or grip to assist the golfer in addressing the ball for different golf shots, such as a straight shot or a draw or a fade.

6 Claims, 4 Drawing Sheets

GOLF CLUB INCLUDING POSITIONING AID

FIELD OF THE INVENTION

This invention relates to golf equipment and to a method and apparatus for stance improvement including at least one optical sight and/or aperture located in the grip or shaft of a golf club so that the ground or light is visible to the player when the club is properly aligned, the player's feet are properly located and the player's head is in the correct position for a golf shot.

DESCRIPTION OF THE PRIOR ART

Paisley, U.S. Pat. No. 2,463,798 shows a putter with a sight in the club head to position the face of the club head perpendicular to the path to the cup. The sight uses a system of mirrors and marks for alignment and visibility.

Ehmke, U.S. Pat. No. 3,109,022 disclosed a putter with a reflector to provide an image of the green, cup or pin to the player and a sight line for the head.

Werner, U.S. Pat. No. 4,832,344, relates to a runner for a club to reduce friction between the head and the grass. The runner changes height and location.

Bang, U.S. Pat. No. 4,953,866 shows a putter with a mirror in the club and a hole in the club face permitting the player to see the cup through the head.

Johnson, U.S. Pat. No. 5,234,217 marks the club grip or shaft for directing the club head as a function of the visibility of the marks to the player.

Canadian patent 567,546 discloses a sight attached to the club shaft above the blade. The sight has a mirror aligned so that the player can see the hole or the flag. Two marks are provided, one in the mirror and another on the blade to aid in aligning the club.

Many of the above prior art patents rely on establishing a direct line of sight from the eyes of the golfer, directly downward to the top of the club head and then, by the use of a reflector or mirror, to the hole or pin. They relate primarily to the putters and employ cumbersome devices with cannot be easily or unobtrusively appended to a golf club.

The prior art attempts to recognize several problems a golfer encounters in lining up and executing a golf shot. Some of these problems an proposed solutions are discussed in the book, THE GOLF SHOT SIMPLIFIED, by John Jacobs, published in 1993 by Lyons and Burford.

The first thing a golfer does preparatory to hitting the golf shot is to address the ball, i.e. place the club head so that its bottom edge or sole is flat on the ground directly in back of the ball. The club head is "in back of" a ball if an imaginary line is drawn from the spot where the ball is resting to the hole the golfer is shooting for. This is called the "line of flight". The golfer desires to address the ball by putting the club on an extension of the line of flight in back of the ball, with the bottom edge or sole of the club head exactly at right angles to the target.

The golfer's swing will follow the line of sight to some extent because it is desired to hit the ball straight. The golfer must deliver the clubface to the ball looking directly at the target, or "square" to the target, or the ball will be hit an angle to the line of flight. Even a slight angle at the point of impact has a large effect over the distance of travel of the ball resulting variously in balls being "hooked" or pulled to the left, or "sliced" or pushed to the right.

The golfer's feet at address should be almost perpendicular to the line of flight and the golfer's knees, hips, and shoulders should be parallel to the line of flight. The golfer's feet will be placed in a natural spread about as wide apart as the shoulders. The toes of the shoes will be up to a line which is parallel to the line of flight.

One of the problems encountered by a golfer in addressing the ball is to determine how close or how far from the ball the golfer should stand. If the golfer stands too far back from the ball, the club head will not lie flat on the ground; rather, the toe of the club will be elevated and the shot will be a mis-hit. If the golfer stands too close to the ball, the heel of the club will be off ground also resulting in a mis-hit.

A related problem is to determine how upright the golfer should stand. Most golf professionals recommend that the knees be somewhat flexed, but most poor golfers either bend their knees too much or not enough resulting in a stance which is either too squat or too erect.

A still further problem is the difficulty in determining the exact point between the right and left foot to place the ball and club head. The desired club head path on the forward swing is from inside to along the target line and back inside; the proper point of impact being when the club head is moving along the target line. If the ball is placed too far to the right in the stance, the club will still be moving from inside to the right of the target at impact, causing the ball to be hit to the right. Placement of the ball to far to the left in the stance will produce an opposite, and equally unsatisfactory, result. These factors are discussed in greater detail at page 47 of the book HOW TO PLAY YOUR BEST GOLF ALL THE TIME, by Tommy Armour, published in 1961 by Fawcett World Library, which diagrams the proper positions for various golf clubs.

The design of golf clubs is of some help to the golfer in addressing the ball. There are lines or grooves on the face of the club head which should, ideally, be perpendicular to the proposed line of flight of the ball. In addition, by varying the loft of each club head, the distance of the shot is varied—the less loft, the longer the shot. The lower lofted clubs, (3, 4 or 5 irons) are designed to lie flat on the ground and address at a point which is closer to the left foot than the right. The higher lofted clubs (8 or 9 irons or pitching wedge), are designed to played closer to the right foot. Page 75 of Armour, supra, also illustrates these characteristics.

The difficulty in relying on the design of the club to assume a proper stance at address is that the club head is at the opposite end of the shaft which is gripped by the golfer. Consequently, it is very difficult for a golfer to determine whether the bottom of the club head is lying flat on the ground perpendicular to the line of flight (which will be the case only if it is properly positioned between the left and the right foot at the point where the club head will be square to the target at impact).

The present invention assists the golfer in solving the above problems by providing a player with an independent way to align stance. The invention includes at least one hole drilled through the upper portion of the grip or shaft at the point where the plumb line of sight of a golfer to the ground intersects with the grip or shaft. The hole may be wider at its top than at its bottom to allow for the placement of a magnification lens at the top of the hole.

The hole is drilled so as to permit the golfer to see the ground (or, at least, visualize light) through the stance scope only if the club head is properly positioned behind the ball at address. If the golfer cannot see the ground or light through the stance scope when looking directly down on it plumb to the ground, then the club is not properly positioned.

The stance scope is designed to require a golfer to adjust stance so that the light or ground cannot be seen or centered in the scope unless the golfer is standing the proper distance from the ball, the club head is centered directly in back of the ball so that the club head is perpendicular to the anticipated line of flight, and the bottom edge or sole of the clubhead is flat on the ground so as to strike the ball at the proper angle of inclination. If these aspects of alignment of the shot are correct, the golfer will also find that the proper knee flex has been achieved so that the stance is neither too squat nor too erect.

The stance scope can be used with any club which is designed to hit down on a ball because, at address, a golfer's hands will be either above or in front of the ball when the club face is placed behind the ball. With respect to any such club—whether an iron or a fairway wood—there will be a point on the shaft or grip, which will lie directly under the imaginary line from the golfer's eyes plumb to the ground when the golfer is addressing the ball immediately before the shot (Armour, supra, page 75). It is at this point that the stance scope should be placed.

The present invention is not intended to be used with the driver because the driver is designed so that the hands will be behind the ball at the point of impact during the swing. Unlike irons and fairway woods, the driver is designed to strike the ball on the upswing (as the club face is rising) rather than the downswing (as the club face is descending toward the ground). Therefore, at address, the ball will be ahead of the hands, and there will be no point on the shaft or handle which will lie directly under the plumb line of sight.

Because the hole for the stance scope can be drilled at any angle chosen by the manufacturer, the stance scope can be customized, if desired, to meet the special needs of a golfer; for example, it can be customized to permit a golfer to hit a controlled draw or face as opposed to a completely straight shot. It is also foreseeable to use a stance scope which is adjustable or has alternative markings or to use a group of stance scopes, which would permit the golfer to address the ball in a manner which will produce a draw or fade as well as or in lieu of a straight shot.

SUMMARY OF THE INVENTION

The present invention is an apparatus for enabling a golfer to assume the proper stance, clubface alignment and angle of attack in addressing the ball. The invention includes an aperture drilled into the grip or shaft of a golf club at a location along the length of the grip or shaft so that, for that club, the club head will be positioned correctly when the golfer can see the ground or light through the aperture when addressing the ball. The aperture may include an insert which incorporates at least one optical magnifying lens to enhance the visibility of the ground or light to the golfer.

A principal object and advantage of the present invention is the provision of an aperture which may include an apparatus for correcting a golfer's stance when addressing the ball. A still further object and advantage of the present invention is the provision of a stance improvement aperture and/or apparatus which requires minimal modification to the golf clubs. Another object and advantage of the present invention is the provision of an aperture and/or optical stance scope which can be added onto existing golf clubs as well included in the manufacture of new golf clubs.

A still further object and advantage of the present invention is the provision of a method for stance improvement which relies on minimal modification of a golfer's equipment. Another object and advantage of the present invention is the provision of a method for stance improvement which can be used with both woods and irons. Another object and advantage of my invention is the provision of a method and apparatus for stance improvement which enables the golfer to perform with greater ease, the steps of aligning himself or herself so that feet, knees, hips and shoulders are square to the clubface or parallel to the target line as discused in Jacobs, supra, at page 61.

BRIEF DESCRIPTION OF THE DRAWINGS

These as well as further objects and advantages of the invention will become apparent to those skilled in the art from a review of the following detailed specification of my invention reference being made to the accompanying drawings in which.

DETAILED DESCRIPTION OF THE INVENTION

Pages 77–80 of Armour, supra, diagram the position of the club and the golfer for the fairway wood shot, the long iron shot, the pitch shot and the chip shot, respectively. These diagrams show the points of intersection between the golfer's eyes and the grip or shaft of the club for the various shots. The present invention relies on the need for that intersection between line of sight and club grip or shaft in properly addressing the ball for those shots.

Figure 1A:
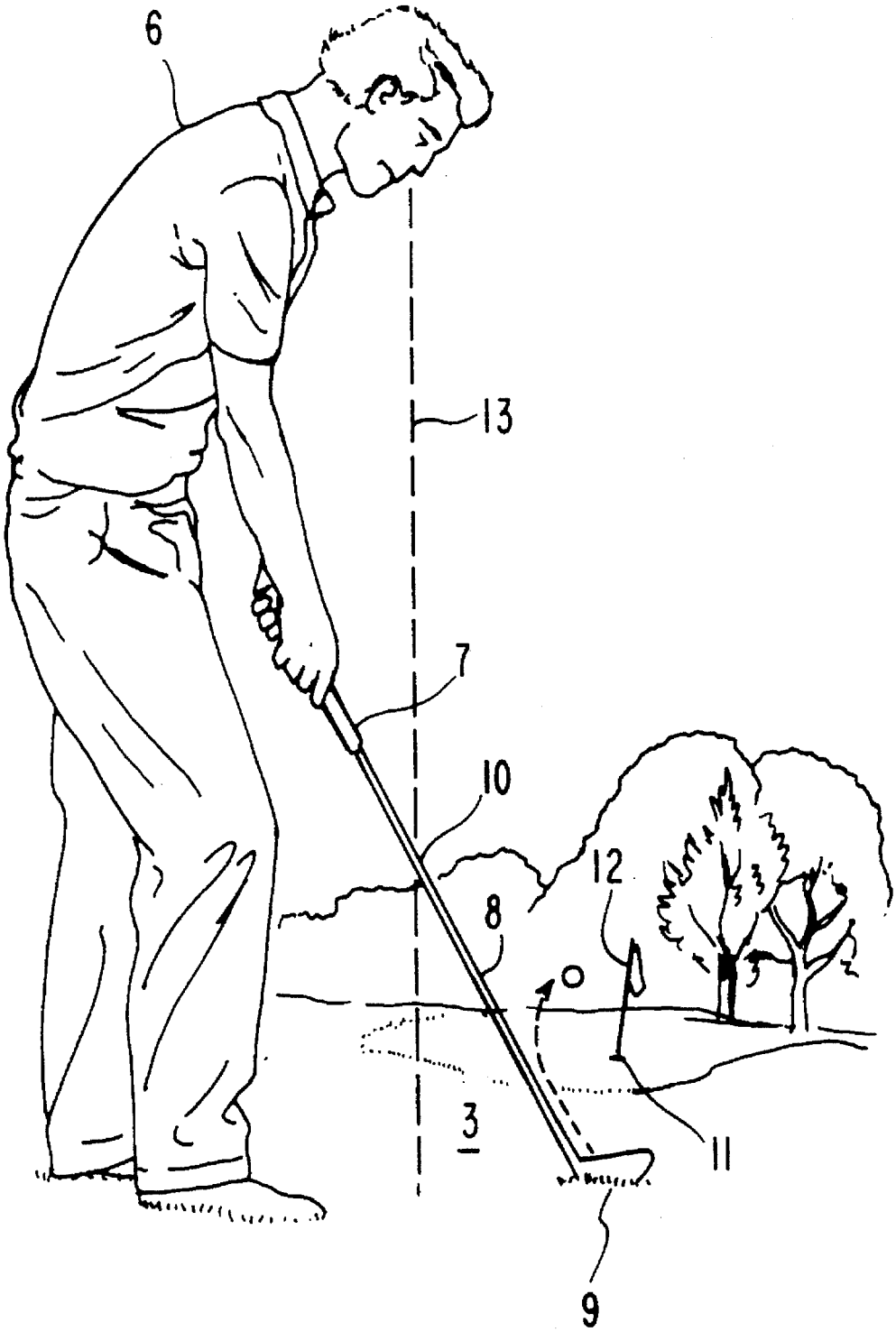
FIGS. 1A–1B are diagrammatic views of a golfer addressing the ball with my invention.
Figure 1B:
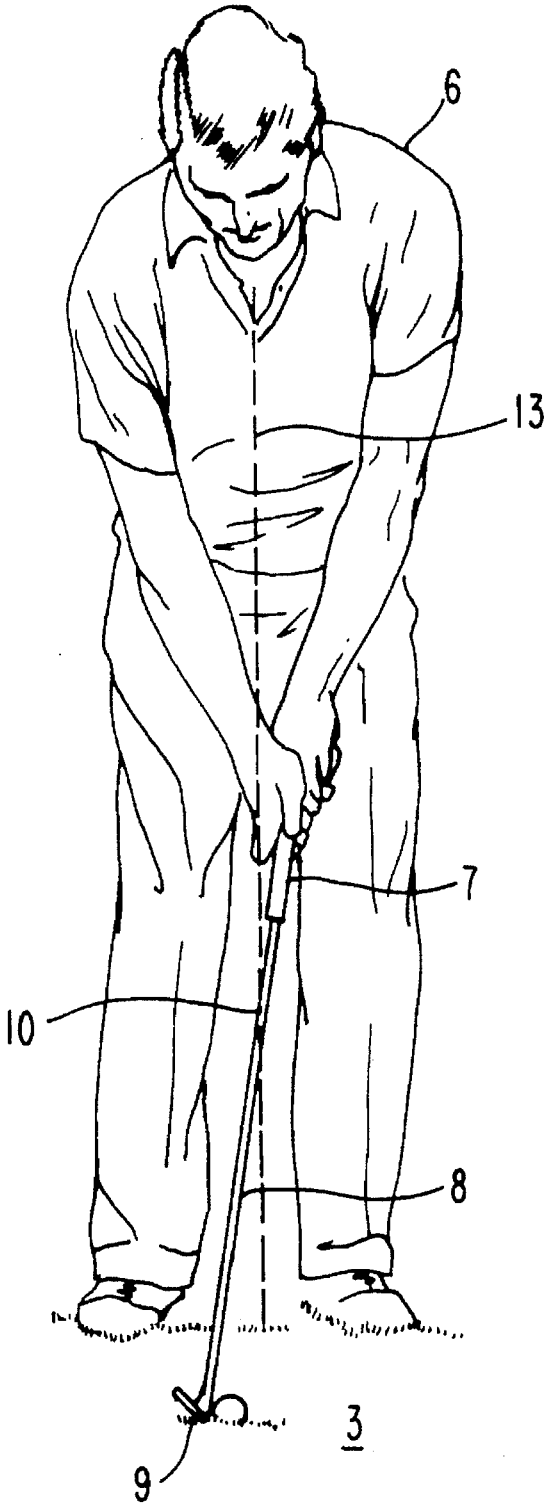

FIGS. 1A–1B are diagrammatic views of a golfer addressing the ball for a long iron shot. As discussed at page 78 of Armour, supra, the proper address of the ball requires the golfer to have the hands over, or slightly ahead of the ball, the weight slightly on the left foot, the knees slightly bent, a square stance with the toes pointed out a bit, and the ball back from the left heel, almost equidistant between the feet. The golfer is shown at numeral 6 assuming the position illustrated in Armour. The proper line of sight 13 for this shot intersects the club shaft.

The golfer is using a club having a grip 7, a shaft 8 and a head 9. The distance to be traveled over the course 3 is to hole 11 marked by flag 12. The invention involves forming an aperture shown generally at 10 in the club shaft at the intersection between the line of sight 13 and the club shaft 8. This aperture is to permit the golfer to see the ground 3 or light through the aperture at 10.

Figure 2:
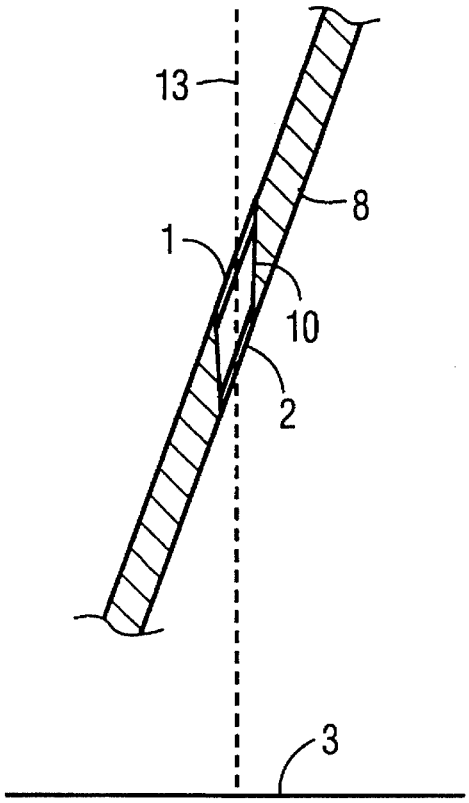
FIG. 2 is an exploded view, partially in section, of a club shaft modified in accordance with my invention.
Figure 3:
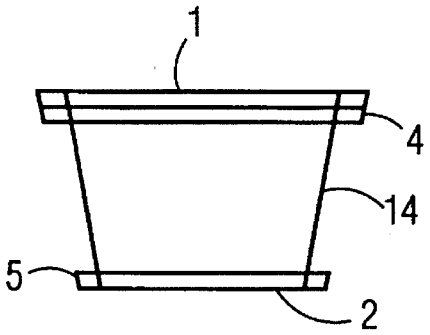
FIG. 3 is a side view, partially in section, of an insert for grip or shaft modification shown in FIG. 2.
Figure 4:
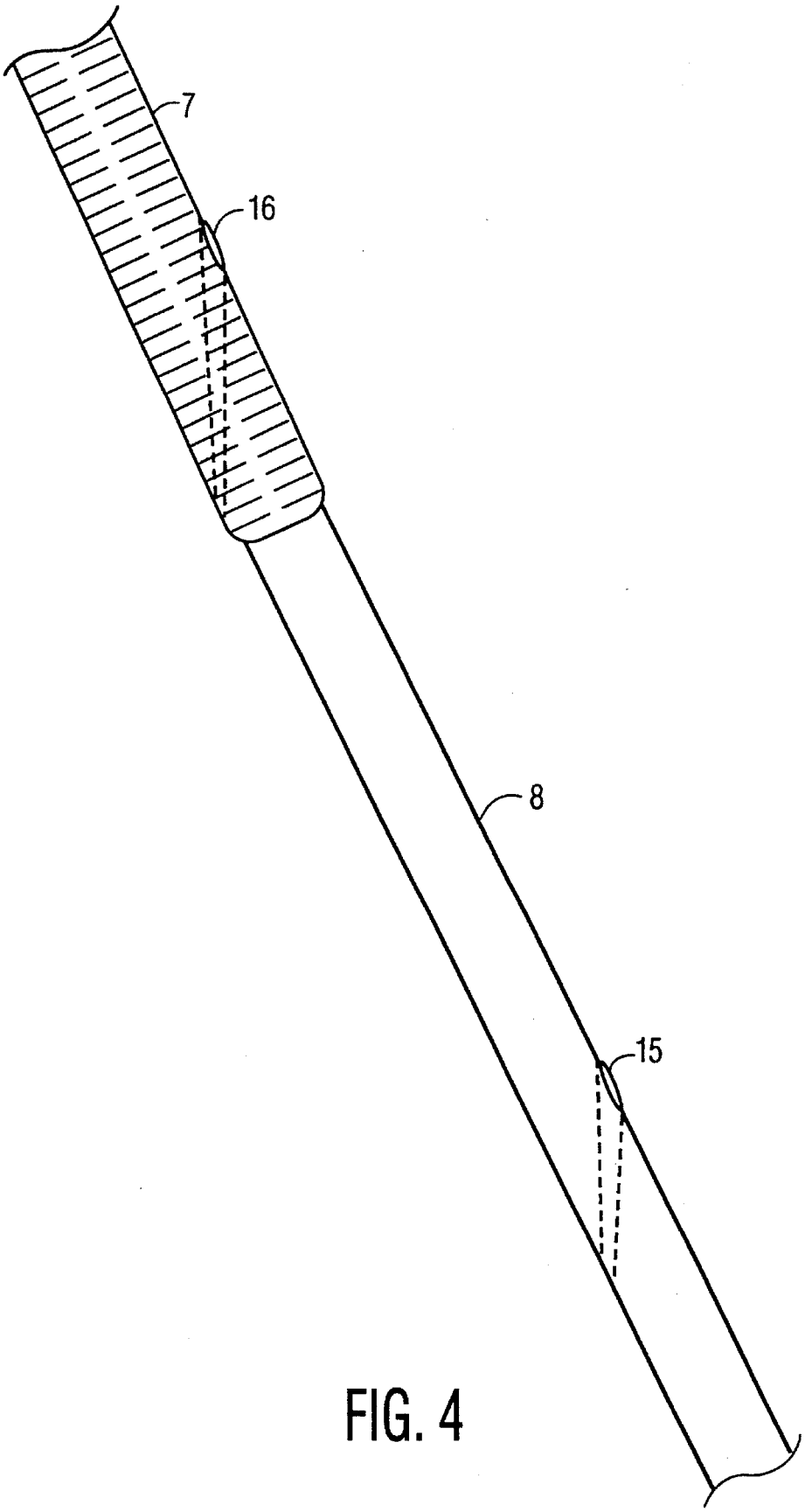
FIG. 4 a side view of a club grip and shaft modified in accordance with another embodiment of my invention.

Referring now to FIGS. 2–3, the aperture in the club grip or shaft 8 is shown generally at 10. In FIG. 4, the aperture is shown closer to scale in the grip at 16 and in the shaft at 15. One or more optical magnifying lenses, such as 1 and 2 in FIG. 3, may be incorporated in the aperture to aid the golfer in seeing the ground. These lenses can be mounted in the manner shown in FIG. 2, or as shown in FIG. 3 where an insert 14 for aperture 10 is formed having supporting rings 4 and 5 at opposite ends thereof for receiving and holding lenses 1 and 2, respectively, by threaded engagement with the respective ends of the insert. The aperture 10 and the insert 14 may be of larger diameter at the end nearest the golfer than at the end nearest the ground to aid the golfer in the ability to visualize the ground or see light. The insert 14 may be of shape suitable to interfit within apertures shown in FIGS. 2 or 4.

The insert 14 may be formed of metal, plastic, fiber glass, or of a transparent or translucent material, and may be a cylinder of trapezoidal profile to incorporate the differing diameter end portions discussed above or as a diamond, to interfit within the aperture of FIG. 2. To further enhance the positioning of the golf club, markings, such as cross-hairs, may be added on at least one of the optical lenses. In addition, multiple apertures can be employed in the grip or shaft to accommodate different types of golf shots, such as straight shots, draws, and fades. This is shown in detail in FIG. 4 where aperture 16 is formed in handle 7 and aperture 15 formed in shaft 8.

Further modifications to the method and apparatus of the invention may be made without departing from the spirit and scope of the invention; accordingly, what is sought to be protected is set forth in the appended claims.

I claim:

1. In a golf club having a club head, a grip, and a shaft, an optical sight system for assisting a golfer in positioning said club head and said shaft, said optical sight system including at least one aperture formed in and through said grip or shaft, optical lens means mounted in said aperture for improving the optical image to a golfer, said aperture located in said grip or shaft at a point where the golfer's line of sight plumb to the ground intersects said grip or shaft.

2. The golf club of claim 1 wherein said through aperture has a top side which is wider than its other side.

3. A golf club comprising; a club head, a grip and a shaft, an aperture extending through either said grip or said shaft for aiding a golfer in positioning said club, said aperture being located at the point of intersection of said grip or said shaft and the downward line of sight of a golfer for addressing a golf ball with said club and enabling a golfer to see light or the ground through said aperture.

4. The system of claim 3 further including optical lens means mounted in said aperture means for enhancing its visibility for a golfer.

5. The system of claim 4 wherein said aperture means has a substantially cylindrical shape.

6. The system of claim 4 wherein said aperture means has a substantially trapezoidal shape.

* * * * *